US009766008B1

(12) United States Patent
Tate

(10) Patent No.: US 9,766,008 B1
(45) Date of Patent: Sep. 19, 2017

(54) PORTABLE, MODULAR REFRIGERATION DEVICE

(71) Applicant: Mary Ann Tate, Monrovia, CA (US)

(72) Inventor: Mary Ann Tate, Monrovia, CA (US)

( * ) Notice: Subject to any disclaimer, the term of this patent is extended or adjusted under 35 U.S.C. 154(b) by 167 days.

(21) Appl. No.: 14/842,021

(22) Filed: Sep. 1, 2015

(51) Int. Cl.
*F17C 13/00* (2006.01)
*F25D 11/00* (2006.01)
*F25D 23/02* (2006.01)

(52) U.S. Cl.
CPC ..... *F25D 11/003* (2013.01); *F25D 23/02* (2013.01)

(58) Field of Classification Search
CPC ..... F25D 11/003; F25D 23/02; F25D 3/107; F25D 11/00; F25D 3/08; B60N 3/104; B65D 81/18
USPC ..... 62/457.9
See application file for complete search history.

(56) References Cited

U.S. PATENT DOCUMENTS 3,769,805 A * 11/1973 Corini ..... A47F 3/0404 62/250
4,006,606 A 2/1977 Underdue
5,058,393 A 10/1991 Callon
5,345,784 A * 9/1994 Bazemore ..... A47G 23/04 62/371
D431,149 S 9/2000 Cooke
6,269,653 B1 8/2001 Katu
6,799,433 B1 10/2004 Gleason
6,976,371 B2 * 12/2005 Gleason ..... A47G 19/26 62/3.6
D614,675 S 4/2010 Linder
8,033,060 B2 * 10/2011 Parker ..... E04B 7/08 220/252
8,573,718 B2 11/2013 Griffiths
2004/0118141 A1 * 6/2004 Kim ..... F25D 11/00 62/258
2005/0040173 A1 * 2/2005 Wuestman ..... A47J 39/02 220/592.28
2007/0012069 A1 * 1/2007 Girard ..... F25D 3/08 62/459
2011/0072848 A1 * 3/2011 Urban ..... A47G 19/26 62/457.9

FOREIGN PATENT DOCUMENTS

JP 2005037086 6/2006

* cited by examiner

*Primary Examiner* — Len Tran
*Assistant Examiner* — Ana Vazquez
(74) *Attorney, Agent, or Firm* — Kyle A. Fletcher, Esq.

(57) ABSTRACT

The portable, modular refrigeration device includes a base member that supports a refrigeration cycle therein. The base member may be hemispherical in shape, and include a top peripheral edge that enables a pivoting, dome cover to attach thereon. The pivoting, dome cover is also hemispherical in shape, and is made of a translucent material so as to enable view of contents being stored there under. A removable tray is provided, and is seated on a lip provided in the base member. The lip is located below the peripheral edge. The removable tray features a plurality of slots that enable refrigerated air to be directed upwardly from the base member into the pivoting, dome cover.

10 Claims, 5 Drawing Sheets

PORTABLE, MODULAR REFRIGERATION DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of refrigerators, more specifically, a highly portable refrigerator that includes a pivoting, dome cover to view the contents being refrigerated therein.

SUMMARY OF THE INVENTION

The portable, modular refrigeration device includes a base member that supports a refrigeration cycle therein. The base member may be hemispherical in shape, and include a top peripheral edge that enables a pivoting, dome cover to attach thereon. The pivoting, dome cover is also hemispherical in shape, and is made of a translucent material so as to enable view of contents being stored there under. The pivoting, dome cover is further defined with a first dome portion and a second dome portion. The second dome portion is able to pivot with the pivoting, dome cover. Moreover, the second portion has a small outer diameter than an inner diameter of the first portion, which enables the second portion to pivot into the first portion. A removable tray is provided, and is seated on a lip provided in the base member. The lip is located below the peripheral edge. The removable tray features a plurality of slots that enable refrigerated air to be directed upwardly from the base member into the pivoting, dome cover.

An object of the invention is to provide a device that includes a refrigeration cycle, and which is highly portable.

A further object of the invention is to provide a portable refrigerator that may be modular.

A further object of the invention is to include a pivoting, dome that is a cover to enclose and enable viewing of the contents contained therein.

These together with additional objects, features and advantages of the portable, modular refrigeration device will be readily apparent to those of ordinary skill in the art upon reading the following detailed description of presently preferred, but nonetheless illustrative, embodiments of the portable, modular refrigeration device when taken in conjunction with the accompanying drawings.

In this respect, before explaining the current embodiments of the portable, modular refrigeration device in detail, it is to be understood that the portable, modular refrigeration device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable, modular refrigeration device.

It is therefore important that the claims be regarded as including such equivalent construction insofar as they do not depart from the spirit and scope of the portable, modular refrigeration device. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
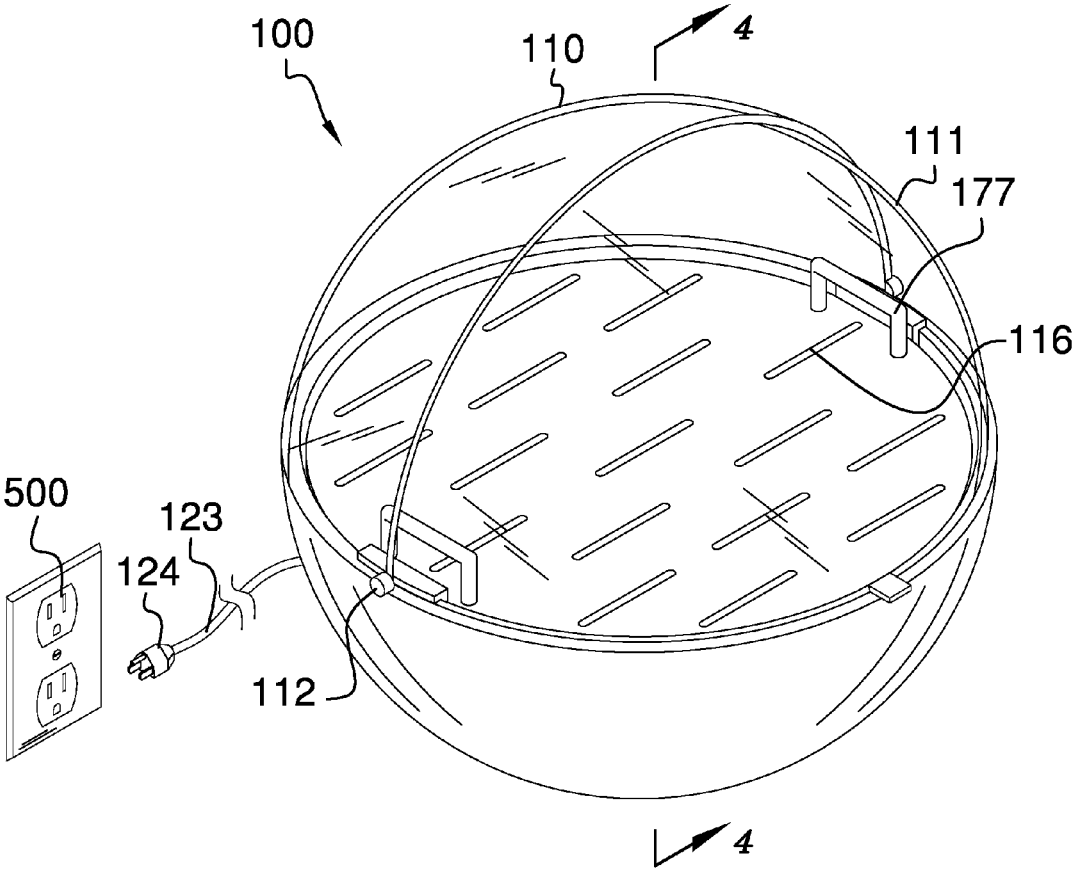
FIG. 1 illustrates a first, perspective view of an embodiment of the disclosure.
Figure 2:
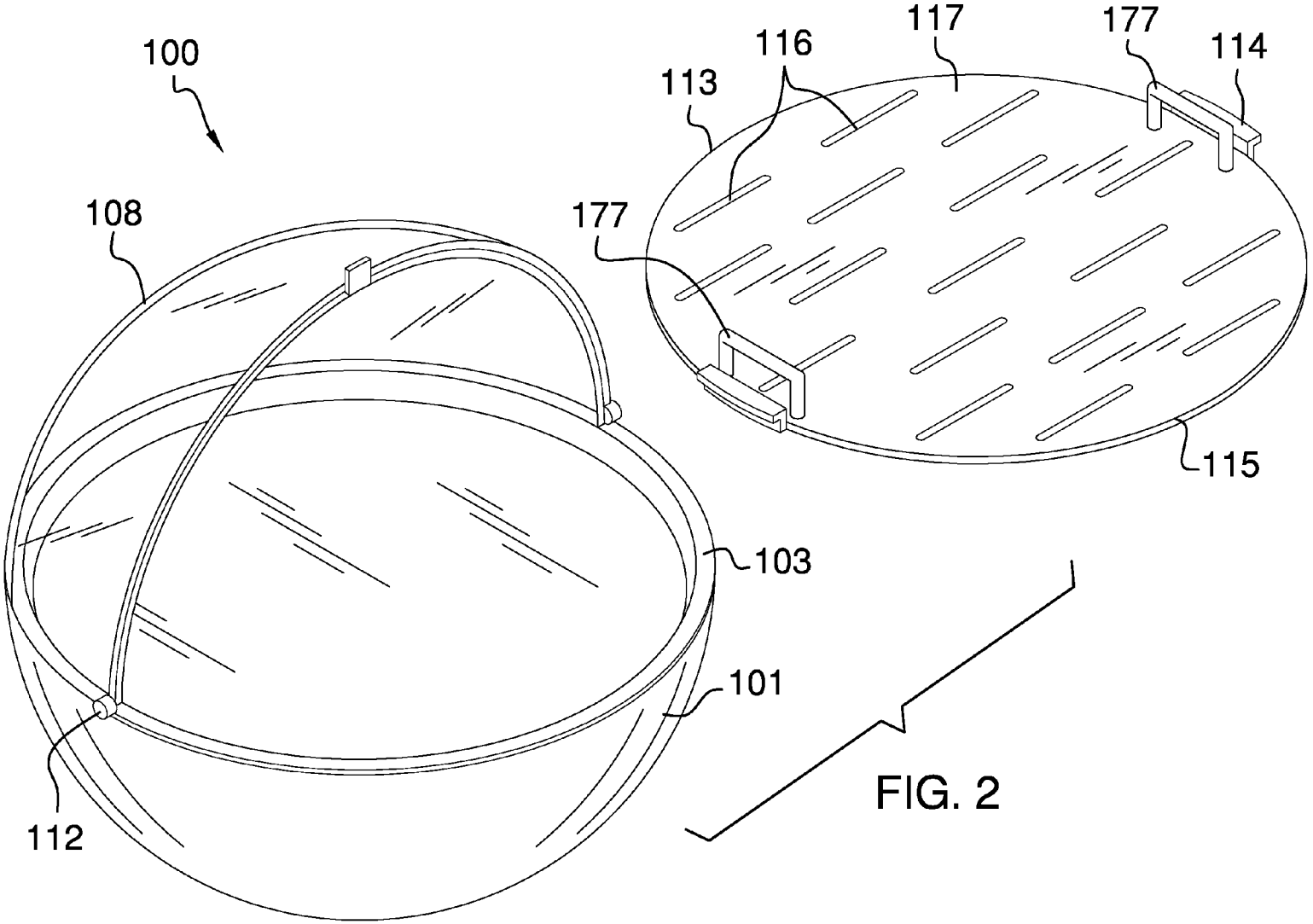
FIG. 2 illustrates an exploded view of an embodiment of the disclosure.
Figure 3:
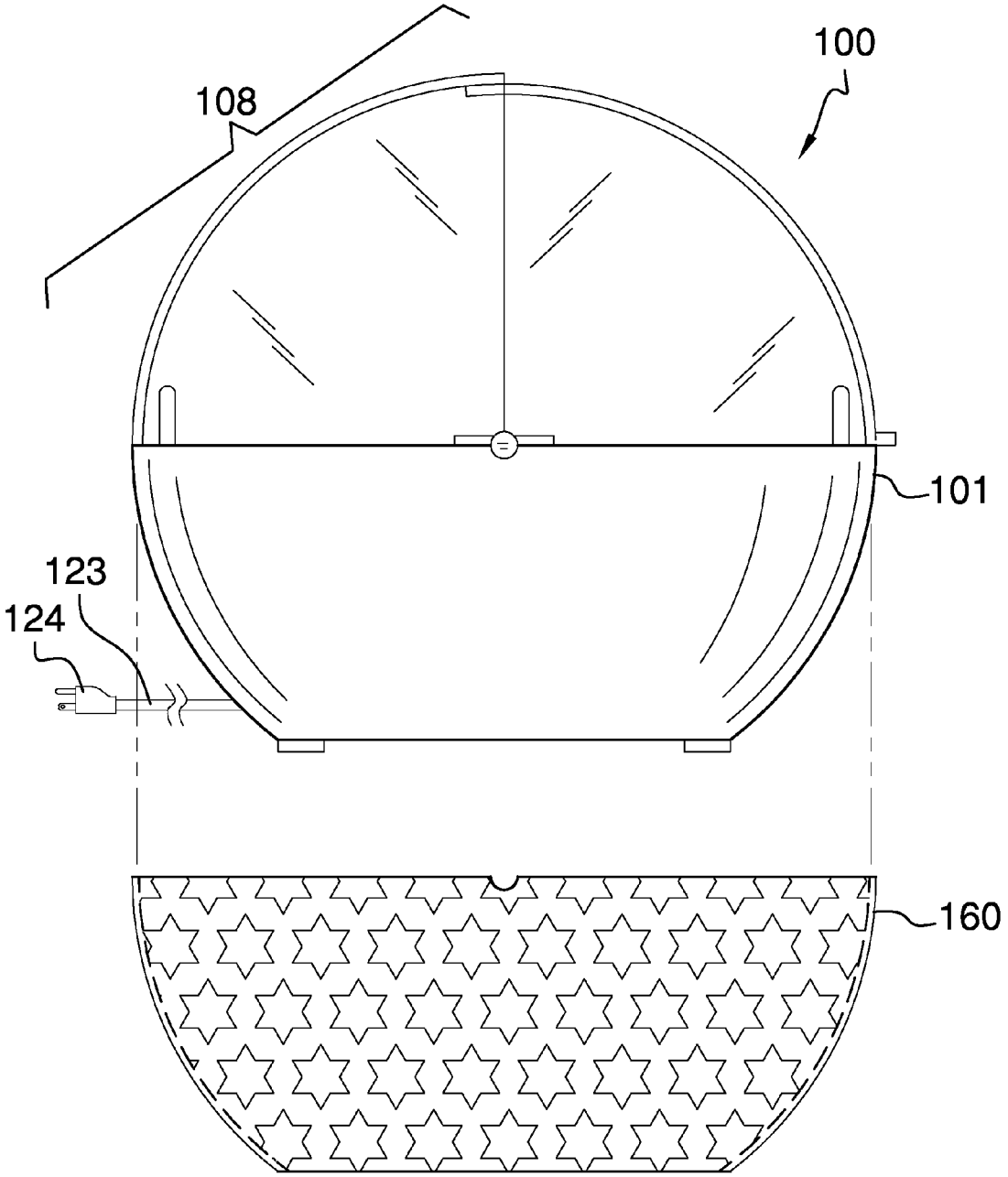
FIG. 3 illustrates a side view of an embodiment of the disclosure.
Figure 4:
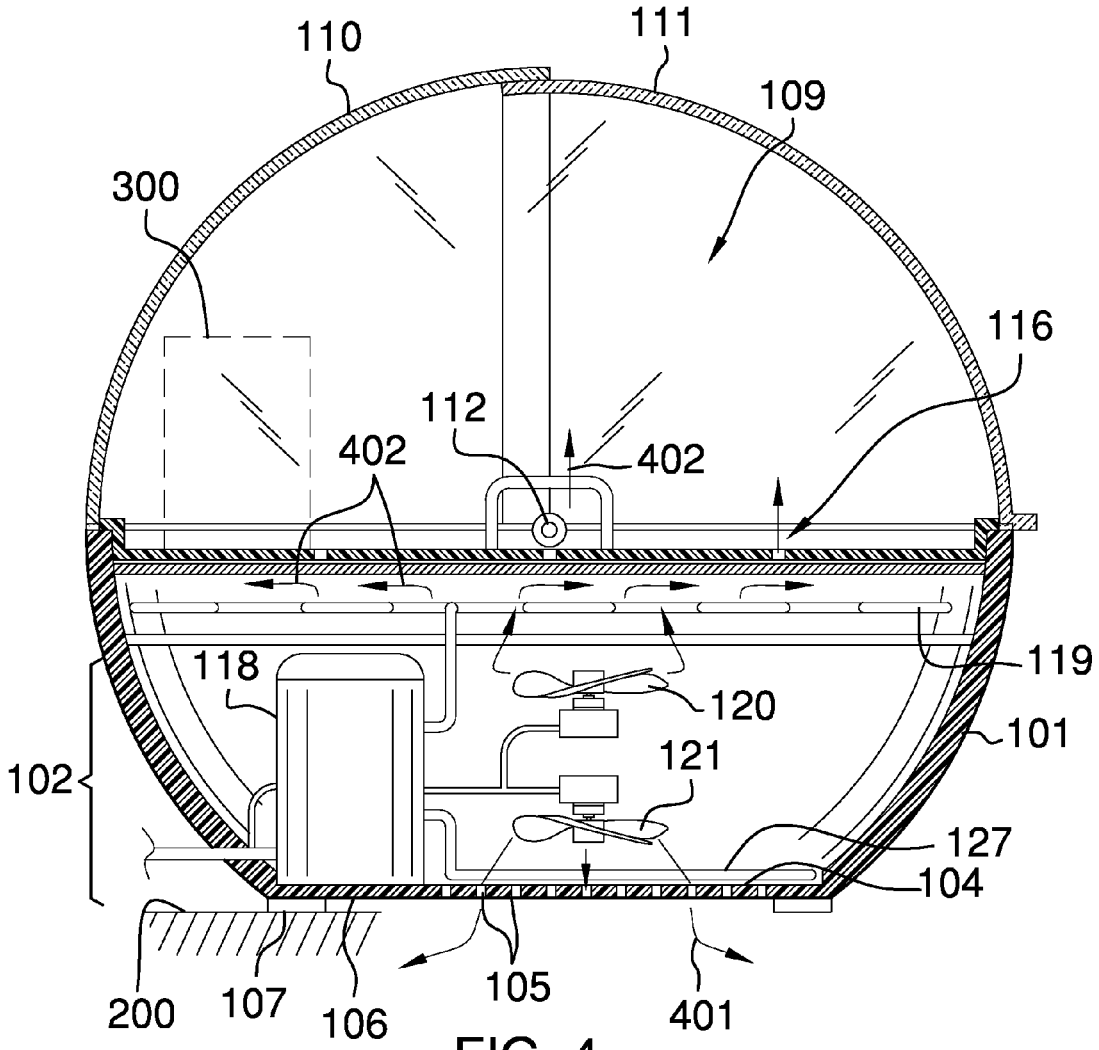
FIG. 4 illustrates a cross-sectional view of an embodiment of the disclosure along line 4-4 in FIG. 1.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A portable, modular refrigeration device 100 (hereinafter invention) is further defined with a base member 101 that supports a refrigeration cycle 102 therein. The base member 101 is hemispherical in shape, and is further defined with a top, peripheral edge 103. The base member 101 has a flat, bottom 104 that includes a plurality of vent slots 105 provided thereon. The flat, bottom 104 of the base member 101 is further defined with a bottom surface 106 that includes a plurality of feet 107 thereon. The plurality of feet 107 are adapted to rest on a ground surface 200 in order to support the invention 100.

The invention 100 includes a pivoting, dome cover 108 that is able to be seated atop of the base member 101. Moreover, the pivoting, dome cover 108 rests upon the top, peripheral edge 103 of the base member 101. The pivoting, dome cover 108 is made of a translucent material so as to enable viewing of an interior 109 of the pivoting, dome cover 108. The pivoting, dome cover 108 is further defined with a first dome portion 110 and a second dome portion 111. The second dome portion 111 is able to pivot via a hinge 112 in order to enable access to the interior 109 of the pivoting, dome cover 108. Moreover, the first dome portion 110 remains stationary whereas the second dome portion 111 is able to rotate within the first dome portion 110.

The invention 100 includes a removable tray 113. The removable tray 113 is able to be seated on the base member 101. Moreover, the removable tray 113 rests at the top, peripheral edge 103. The removable tray 113 includes at least one tray bracket 114 that extends outwardly as well as upwardly from a tray edge 115. The at least one tray bracket 114 touches the top, peripheral edge 103 of the base member 101 such that the removable tray 113 is seated below the top, peripheral edge 103 of the base member 101. The removable tray 113 may further include at least one tray handle 177. The at least one tray handle 177 extends upwardly from the removable tray 113 in order to provide a means for carrying the removable tray 113.

The removable tray 113 is further defined with a plurality of tray slots 116 thereon. The plurality of tray slots 116 may be elongated circles in shape, and may form a pattern across a surface area of the removable tray 113. The removable tray 113 is further defined with a top tray surface 117 that is adapted to an enable an object 300 to rest thereon. The premise of the invention 100 is to refrigerate the object 300 that is supported on the top tray surface 117 of the removable tray 113.

The base member 101 may include a base cover 160 that is highly decorative, and is placed over the base member 101 from underneath the base member 101. The base member 101 include the refrigeration cycle 102 therein. Moreover, the refrigeration cycle 102 includes, among other things, a compressor 118, a refrigeration coil 119, and a condenser coil 127. The refrigeration coil 119 traverses back and forth underneath the removable tray 113. Moreover, the condenser coil 127 traverses back and forth adjacent to the flat, bottom 104 of the base member 101 in order for heated air 401 to be ventilated through the plurality of vent slots 105 provided on the flat, bottom 104.

The base member 101 includes a first fan 120 and a second fan 121. The first fan 120 accelerates air upwardly across the refrigeration coil 119 in order to form the refrigerated air 402 that is directed upwardly to cool a refrigeration partition 178. The refrigeration partition 178 is located below the removable tray 117 as well as the top, peripheral edge 103 of the base member 101. The refrigeration partition 178 is cooled via the refrigerated air 402. The air located within the interior 109 is chilled via the refrigeration partition 178.

The second fan 121 accelerates air downwardly across the condenser coil 127 in order to remove heat that is generated via the refrigeration cycle 102 thereby forming the heated air 401 that is ventilated out of the base member 101 via the vent slots 105 provided on the flat, bottom 104. The compressor 118 is connected to an electrical cord 123 that includes an electrical plug 124 adapted to be connected to an electrical outlet 500.

Figure 5:
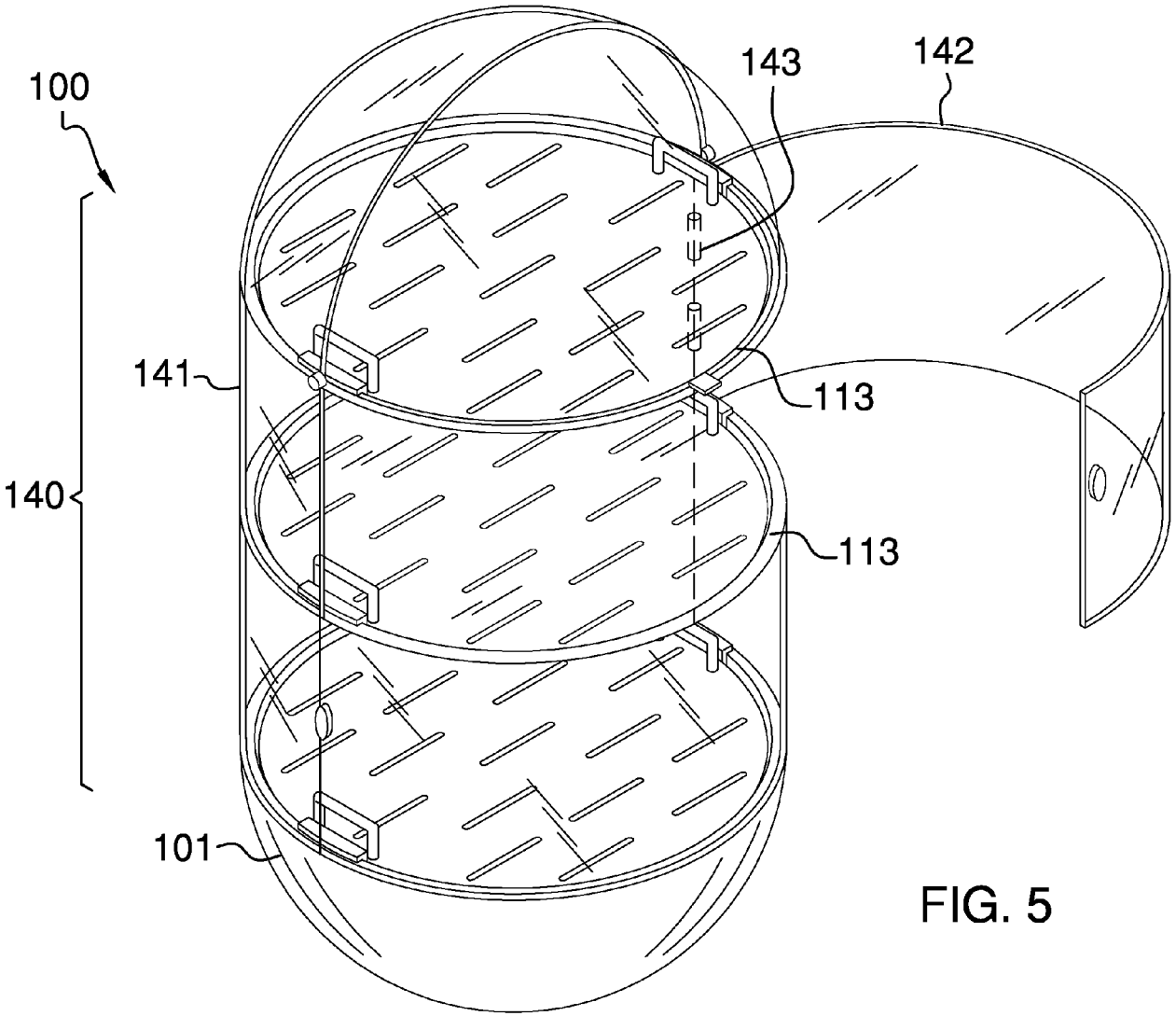
FIG. 5 illustrates a perspective view of an alternative embodiment of the disclosure.

Referring to FIG. 5, the invention 100 is modular in that an expansion cover 140 may be installed in between the base member 101 and the pivoting, dome cover 108. The expansion cover 140 is made of a translucent material, and is essentially a cylinder that enables a plurality of the removable trays 113 to be stacked vertically in order to increase the overall volume of the interior 109. The expansion cover 140 includes a first expansion cover 141 that rests atop of the top, peripheral edge 103 of the base member 101. A second expansion cover 142 is attached to the first expansion cover 141 via an expansion hinge 143. The second expansion cover 142 rotates outwardly to provide access to the interior 109 of the invention 100.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable, modular refrigeration device comprising:

a base member into which a refrigeration cycle is included;

wherein a pivoting, dome cover is added onto the base member in order to form an interior into which an object is to be refrigerated;

wherein a removable tray is placed on the base member and is adapted to enable the object to be placed thereon;

wherein the base member is hemispherical in shape, and is further defined with a top, peripheral edge;

wherein the base member has a flat, bottom that includes a plurality of vent slots provided thereon;

wherein the flat, bottom of the base member is further defined with a bottom surface that includes a plurality of feet thereon;

wherein the plurality of feet are adapted to rest on a ground surface;

wherein the pivoting, dome cover rests upon the top, peripheral edge of the base member;

wherein the pivoting, dome cover is made of a translucent material so as to enable viewing of the interior of the pivoting, dome cover;

wherein the pivoting, dome cover is further defined with a first dome portion and a second dome portion;

wherein the second dome portion is able to pivot via a hinge in order to enable access to the interior of the pivoting, dome cover;

wherein the first dome portion remains stationary whereas the second dome portion is able to rotate within the first dome portion;

wherein the removable tray is able to be seated on the base member;

wherein the removable tray rests at the top, peripheral edge;

wherein the removable tray includes at least one tray bracket that extends outwardly as well as upwardly from a tray edge;

wherein the at least one tray bracket touches the top, peripheral edge of the base member such that the removable tray is seated below the top, peripheral edge of the base member;

wherein the removable tray is further defined with a plurality of tray slots thereon;

wherein the plurality of tray slots are further defined as elongated circles in shape, and form a pattern across a surface area of the removable tray;

wherein the removable tray is further defined with a top tray surface that is adapted to enable the object to rest thereon;

wherein the refrigeration cycle includes, a compressor, a refrigeration coil, and a condenser coil;

wherein the refrigeration coil traverses back and forth underneath the removable tray;

wherein the condenser coil traverses back and forth adjacent to the flat, bottom of the base member in order for heated air to be ventilated through the plurality of vent slots provided on the flat, bottom;

wherein refrigerated air from the refrigeration coil is directed upwardly to cool a refrigeration partition.

2. The portable, modular refrigeration device as described in claim 1 wherein the base member includes a first fan and a second fan; wherein the first fan accelerates air upwardly across the refrigeration coil in order to form the refrigerated air that chills the refrigeration partition, which in turn cools air located within said interior of said pivoting, dome cover.

3. The portable, modular refrigeration device as described in claim 2 wherein the second fan accelerates air downwardly across the condenser coil in order to remove heat that is generated via the refrigeration cycle thereby forming the heated air that is ventilated out of the base member via the vent slots provided on the flat, bottom.

4. The portable, modular refrigeration device as described in claim 3 wherein the compressor, the first fan, and the second fan are all connected to an electrical cord that includes an electrical plug; wherein the electrical plug is adapted to be connected to an electrical outlet.

5. The portable, modular refrigeration device as described in claim 4 wherein an expansion cover is installed in between the base member and the pivoting, dome cover.

6. The portable, modular refrigeration device as described in claim 5 wherein the removable tray is a plurality of removable trays; wherein the expansion cover is made of a translucent material, and is a cylinder that enables the plurality of the removable trays to be stacked vertically in order to increase the overall volume of the interior.

7. The portable, modular refrigeration device as described in claim 6 wherein the expansion cover includes a first expansion cover that rests atop of the top, peripheral edge of the base member.

8. The portable, modular refrigeration device as described in claim 7 wherein a second expansion cover is attached to the first expansion cover via an expansion hinge; wherein the second expansion cover rotates outwardly to provide access to the interior.

9. The portable, modular refrigeration device as described in claim 8 wherein the removable tray includes at least one tray handle; wherein the at least one tray handle extends upwardly from the removable tray in order to provide a means for carrying the removable tray.

10. The portable, modular refrigeration device as described in claim 9 wherein the refrigeration partition is located below the removable tray as well as the top, peripheral edge of the base member.

* * * * *